US008073348B2

(12) United States Patent
Ozeki

(10) Patent No.: US 8,073,348 B2
(45) Date of Patent: Dec. 6, 2011

(54) IMAGE FORMING APPARATUS

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 307 days.

(21) Appl. No.: 12/379,525

(22) Filed: Feb. 24, 2009

(65) Prior Publication Data

US 2009/0214237 A1 Aug. 27, 2009

(30) Foreign Application Priority Data

Feb. 25, 2008 (JP) ..... 2008-043343

(51) Int. Cl.
*G03G 15/00* (2006.01)

(52) U.S. Cl. ..... 399/44; 399/55; 399/94; 399/285

(58) Field of Classification Search ..... 399/38, 399/44, 53, 55, 91, 94, 97, 222, 240, 279, 399/285

See application file for complete search history.

(56) References Cited

U.S. PATENT DOCUMENTS 5,887,220 A * 3/1999 Nagaoka ..... 399/46
2004/0101324 A1* 5/2004 Kawano ..... 399/55
2005/0047808 A1* 3/2005 Yamamura ..... 399/44
2005/0095023 A1* 5/2005 Kyung et al. ..... 399/44
2006/0204258 A1* 9/2006 Yamane ..... 399/44

FOREIGN PATENT DOCUMENTS

JP 2002-108089 4/2002

* cited by examiner

*Primary Examiner* — David Porta
*Assistant Examiner* — Benjamin Schmitt
(74) *Attorney, Agent, or Firm* — Rabin & Berdo, P.C.

(57) ABSTRACT

An image forming apparatus forms images. A developer bearing body receives a first voltage and supplies developer to the electrostatic latent image formed on an image bearing body. A supplying member receives a second voltage and supplies the developer to said developer bearing body. A detector detects at least one of an environmental condition, e.g., temperature and humidity outside of an apparatus and an environmental condition e.g., temperature inside of the apparatus. A controller controls the difference between the first voltage and the second voltage in accordance the environmental conditions. The controller makes a decision to determine whether the outside temperature is not lower than a first reference, whether outside humidity is not higher than a second reference, and whether inside temperature is not lower than a third reference. If the above criteria are met, the controller decreases the absolute value of the difference.

4 Claims, 13 Drawing Sheets

TEMPERATURE INSIDE OF PRINTER : 35℃
TEMPERATURE OUTSIDE OF PRINTER : 32℃
HUMIDITY OUTSIDE OF PRINTER : 20%

TEMPERATURE INSIDE OF PRINTER : 45℃
TEMPERATURE OUTSIDE OF PRINTER : 28℃
HUMIDITY OUTSIDE OF PRINTER : 40%

TEMPERATURE OUTSIDE OF PRINTER : 32℃
HUMIDITY OUTSIDE OF PRINTER : 20%

IMAGE FORMING APPARATUS

BACKGROUND OF THE INVENTION

1. Field of the Invention

The present invention relates to an image forming apparatus.

2. Description of the Related Art

Conventional image forming apparatuses include printers, copying machines, and multi-function peripherals (MFPs). For example, a printer is configured as follows: A charging roller charges the surface of a photoconductive drum. An LED head illuminates the charged surface of the photoconductive drum in accordance with image data to form an electrostatic latent image on the photoconductive drum. A thin layer of toner is formed on a developing roller and the toner on the developing roller is supplied to the electrostatic latent image to form a toner image. The toner image is then transferred onto a print medium or paper. The residual toner on the photoconductive drum is removed by a cleaning blade.

JP 2002-108089A discloses a printer in which the settings (e.g., voltages for charging, developing, and toner supplying operation) for image forming process are set in accordance with the environmental conditions including ambient temperature and humidity when the image forming apparatus is turned on.

A conventional printer suffers from a problem in that soiling of paper may occur to impair print quality due to changes in environmental conditions.

SUMMARY OF THE INVENTION

An object of the invention is to solve the drawbacks of conventional image forming apparatuses.

Another object of the invention is to provide an image forming apparatus in which good print quality is maintained in a variety of environmental conditions.

An image forming apparatus is capable of changing the voltage difference between a developing voltage and a toner supplying voltage. An electrostatic latent image is formed on an image bearing body (12BK). A developer bearing body (16) supplies developer to the electrostatic latent image formed on an image bearing body. A developer supplying member (18) supplies the developer to said developer bearing body (16). A detector detects at least one of an environmental condition, e.g., temperature and humidity outside of an apparatus and an environmental condition e.g., temperature inside of the apparatus. A controller controls the difference between the first voltage and the second voltage in accordance the environmental conditions. The controller makes a decision to determine whether the outside temperature is not lower than a first reference, whether outside humidity is not higher than a second reference, and whether inside temperature is not lower than a third reference. If the above criteria are met, the controller decreases the absolute value of the difference.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings. An image forming apparatus of the invention will be described in terms of a printer.

Figure 1:
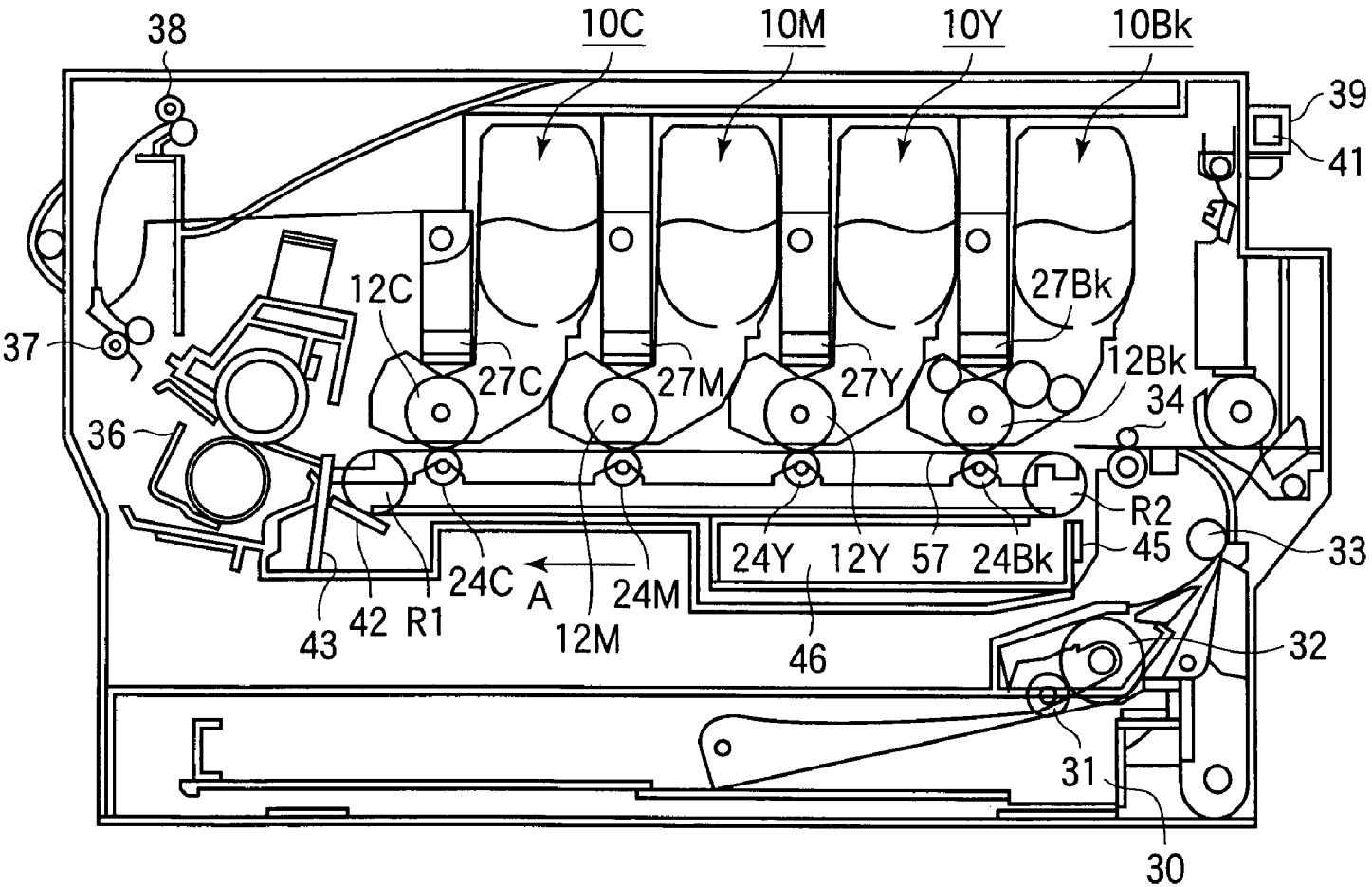
FIG. 1 illustrates the general configuration of a printer of a first embodiment.

FIG. 1 illustrates the general configuration of the printer of a first embodiment.

Referring to FIG. 1, a medium holder or a paper cassette 30 is disposed at a lower portion of the printer. The paper cassette 30 holds a stack of print media (e.g., print paper, not shown). A paper feeding mechanism is disposed adjacent to the front end of the paper cassette 30, and includes a feed roller 31 and a separator roller 32. The paper feeding mechanism feeds the print paper on a page-by-page basis. The print paper is fed to a transport roller 33 and then to a transport roller 34, so that the print paper advances through image forming units (referred to as ID unit hereinafter) 10BK, 10Y, 10M, and 10C that form black, yellow, magenta, and cyan toner images, respectively.

The ID units 10BK, 10Y, 10M, and 10C include image bearing bodies or photoconductive drums 12Bk, 12Y, 12M, and 12C. Disposed around the photoconductive drums 12BK, 12Y, 12M, and 12C are exposing units or LED heads 27BK, 27Y, 27M, and 27C, respectively, which extend in parallel to the photoconductive drums 12BK, 12Y, 12M, and 12C. The exposing units may be a laser type exposing unit. The LED heads illuminate the charged surfaces of the photoconductive drums to form electrostatic latent images of corresponding colors.

A transfer unit is disposed to face the ID units 10BK, 10Y, 10M, and 10C. The transfer unit includes a drive roller (first rotating body) R1, a driven roller (second rotating body) R2, a transport belt 57 disposed about the drive roller R1 and driven roller R2, and transfer rollers 24BK, 24Y, 24M, and 24C. The transport belt 57 is driven by the drive roller R1 to run. The transfer rollers 24BK, 24Y, 24M, and 24C parallel with the photoconductive drums 12BK, 12Y, 12M, and 12C, respectively, with the transport belt 51 sandwiched between the photoconductive drums 12BK, 12Y, 12M, and 12C and the transfer rollers 24BK, 24Y, 24M, and 24C. The ID units 10BK, 10Y, 10M, and 10C, LED heads 27BK, 27Y, 27M, and 27C, transfer rollers 24BK, 24Y, 214M, and 24C cooperate to form black, yellow, magenta, and cyan toner images, respectively, and to transfer the toner images of the respective colors onto the print paper.

The transport belt 57 runs in a direction shown by arrow A to transport the print paper through the respective ID units 10BK, 10Y, 10M, and 12C so that the toner images of the respective colors are transferred onto the print paper in registration to form a full color toner image.

Subsequently, the print paper is advanced to a fixing unit 36 where the full color toner image is fixed into a full color permanent image. Then, the print paper is further advanced by a transport roller 37 from the fixing unit 36 and then by a discharge roller 38 onto a stacker outside of the printer.

Some of the toner may remain on the transfer belt 35 after transfer of the toner image onto the print paper. A cleaning device 45 scrapes the residual toner off the transport belt 57. The residual toner is then collected into a toner container 46.

An external environmental condition detecting section or an external environment detector 41 is disposed at a location where the external environment detector 41 is in contact with the air outside of the printer. The outputs of the external environment detector 41 represent temperature and humidity outside of the printer without being affected by the temperature and humidity inside of the printer. The external environment detector 41 is disposed within an operation panel 39 at the front end of the printer. The external environment detector 41 may be disposed at any location as long as the outputs of the external environment detector 41 are not affected by the temperature and humidity inside of the printer.

An internal temperature detector 42 is disposed inside of the printer in the vicinity of the drive roller 1, and is in contact with the transport belt 57 on a side of the transport belt 57 opposite to the drive roller R1. The internal temperature detector 42 detects the temperature inside of the printer. The internal temperature detector 42 is shielded by a shielding plate 43 so that the output of the internal temperature detector 42 is not affected by the heat generated by the fixing unit 36. The internal temperature detector 42 may be disposed at any location as long as the output of the internal temperature detector 42 is not adversely affected by the heat generated by the fixing unit 36.

The external environment detector 41 may be implemented with, for example, MSM3103J375J or HIS-05N (available from HOKURIKU DENKI KOGYO) and the internal temperature detector 42 may be implemented with, for example, 103ET-1 (available from ISHIZUKA DENSHI).

The configuration of the ID units 10BK, 10Y, 10M, and 10C will be described. Each of the ID units 10BK, 10Y, 10M, and 10C may be substantially identical; for simplicity only the operation of the ID unit 10BK for forming black images will be described, it being understood that the other ID units 10Y, 10M, and 10C may work in a similar fashion.

Figure 3:
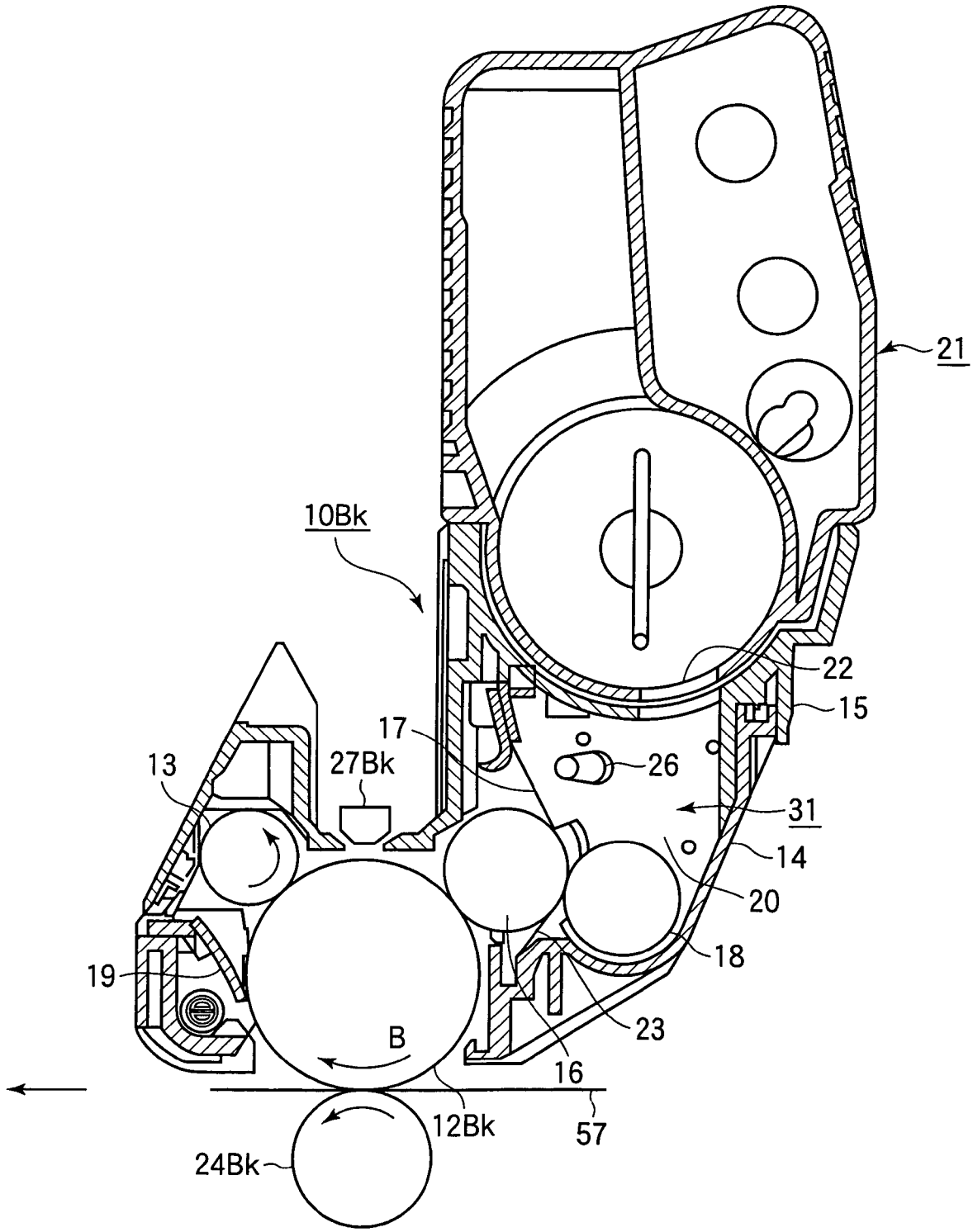
FIG. 3 is a cross sectional view illustrating a pertinent portion of an ID unit.

FIG. 3 is a cross sectional view illustrating a pertinent portion of the ID unit 10BK.

The ID unit 10BK includes a body and a developer cartridge or a toner cartridge 21 detachably attached to the body. The toner cartridge 21 holds toner therein. The toner cartridge 21 includes a bottom wall in which an opening 22 is formed. The ID unit 10BK includes a toner reservoir 20 that receives the tone discharged through the opening 22 from the toner cartridge 21. The LED head 27BK is outside of the ID unit 10BK and over the photoconductive drum 12BK.

The ID unit 10BK includes a charging roller 13, a developing roller 16, a toner supplying roller 18, a developing blade 17, a cleaning blade 19, and an agitator bar 26. The charging roller 13 in contact with the photoconductive drum 12BK under pressure and rotates in the opposite direction to the photoconductive drum 12BK, thereby uniformly charging the circumferential surface of the photoconductive drum 12BK. The developing roller 16 rotates in contact with the photoconductive drum 12BK under pressure, thereby supplying toner to the electrostatic latent image to form a toner image. The toner supplying roller 18 rotates in contact with the developing roller 16 to supply the toner to the developing roller 16. The developing blade 17 has a tip portion in contact with the developing roller 16 to form a thin layer of toner having a uniform thickness on the developing roller 16. The cleaning blade 19 serves as a cleaning member that removes the toner remaining on the photoconductive drum 12BK after transfer of the toner image. The agitator bar 26 agitates the toner in the reservoir 20.

The photoconductive drum 12BK includes an electrically conductive shaft (e.g., aluminum pipe) covered with a photoconductive layer. The photoconductive layer is an organic photoconductor that includes a charge generation layer covered with a charge transport layer.

The charging roller 13, developing roller 16, and toner supply roller 18 are formed of a silicone resin or a urethane resin. The toner supplying roller 18 is formed of a foamed, resilient body having a plurality of cells in its surface. The toner supplying roller 18 and the agitator bar 26 primarily form a developer supplying roller assembly 31. The developing roller 16, toner supplying roller 18, and developing blade 17 form a developing unit.

A belt-shaped film 23 formed of thermal plastic urethane extends along the developing roller 16 in contact with the developing roller 16, thereby preventing the toner from leaking to the photoconductive drum 12.

The cleaning blade 19 is in contact with the photoconductive drum 12BK under pressure, and scrapes the residual toner off the photoconductive drum 12BK. The toner scraped off is then transported by a waste toner transporting spiral and further by a waste toner transporting belt into a waste toner chamber defined in the toner cartridge 21.

The body of the ID unit includes a first case or a base frame 14 and a second case or an upper frame 15. The base frame 14 supports the photoconductive drum 12Bk, the charging roller 13, the developing roller 16, and the cleaning blade 19. The film 23 is mounted to the bottom portion of the base frame 14 by means of a double side adhesive tape, abutting the lower surface of the developing roller 16.

During printing, the developing roller 16 and toner supplying roller 18 are driven in rotation by a motor (not shown) with a certain difference in circumferential speed, so that the toner is supplied from the toner supplying roller 18 to the developing roller 16. The developing blade 17 removes excess toner to form a thin layer of toner on the developing roller 16 as the developing roller 16 rotates, so that the toner layer on the developing roller 16 is brought into contact with the electrostatic latent image formed on the circumferential surface of the photoconductive drum 12BK.

The photoconductive drum 12BK is driven by a drum motor (not shown) in a direction shown by arrow B. The charging roller 13 also rotates in contact with the photoconductive drum 12BK, so that the charging roller 13 uniformly charges the circumferential surface of the photoconductive drum 12BK. The LED head 27BK illuminates the charged surface of the photoconductive drum 12BK to form an electrostatic latent image. The electrostatic latent image is developed with the toner supplied from the developing roller 16 into a toner image, thereby implementing single component development of an electrostatic latent image.

Figure 2:
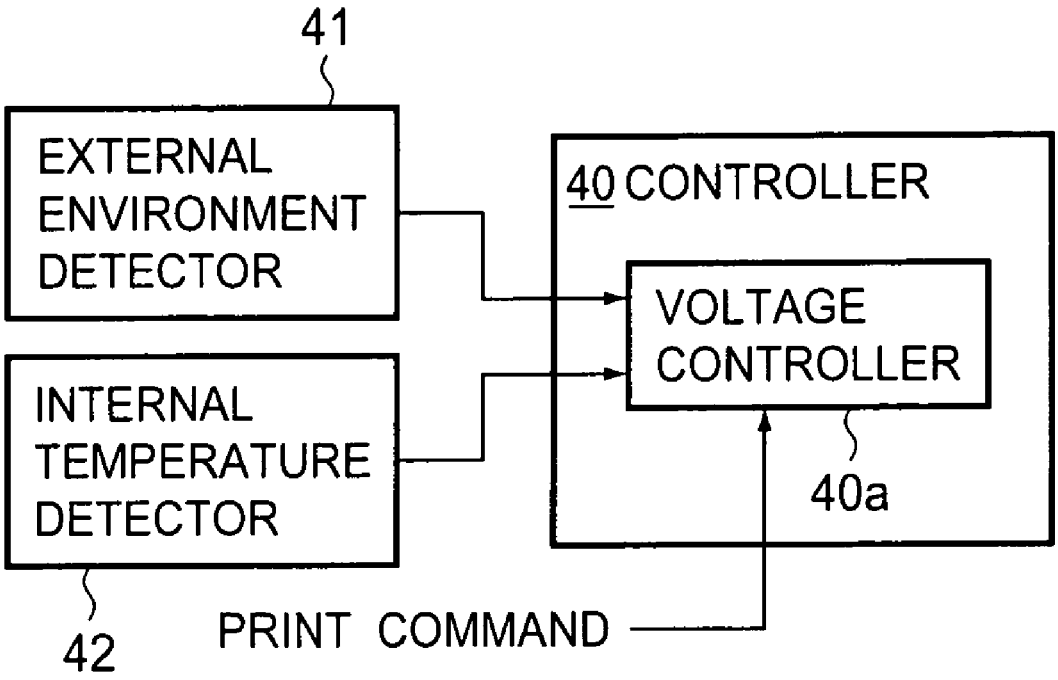
FIG. 2 is a block diagram illustrating a controller of the printer of the first embodiment.

A controller 40 of the printer will be described. FIG. 2 is a block diagram illustrating the controller 40 of the printer of the first embodiment. Referring to FIG. 2, the controller 40 includes a voltage controller 40*a* that controls voltages to be applied to the respective structural members in accordance with the outputs of the external environment detector 41 and the internal temperature detector 42.

The temperature inside the printer relates to soiling of the print paper. Soiling is a phenomenon in which toner adheres to non-image areas on the print paper or an excessive amount of toner adheres to a halftone image to increase darkness of an image.

In the present embodiment, the charged potential, developing voltage, and supplying voltage are negative values, and "high voltage" or "high potential" implies a large absolute value and "low voltage" or "low potential" implies a small absolute voltage.

"Charged potential" is the potential of the circumferential surface of the photoconductive drum 12Bk when the photoconductive drum 12Bk is charged by the charging roller 13 (FIG. 3). "Developing voltage" is the voltage applied to the developing roller 16. "Supplying voltage" is the voltage applied to the toner supplying roller 18. "Toner potential" is the potential of the toner on the developing roller 16. The sum of the developing voltage and the toner potential is usually lower than the charged potential, and therefore the toner will not adhere to non-image areas on the print paper and simply remains on the developing roller 16.

The toner potential of the toner on the developing roller 16 increases with increasing amount of charge, and therefore the sum of the developing voltage and the toner potential may exceed the charged potential of the photoconductive drum so that the toner adheres to non-image areas on the print paper.

{Printing at a Variety of Temperatures}

Printing results at a variety of temperatures inside and outside of the printer, toner potential, and supplying voltage will be described.

Soiling is rated on a scale of 1 to 10. The smaller the rating is, the more serious the soling is. A rating "10" is recorded where no soiling is observed. A rating "9" is recorded where the darkness of a halftone image is slightly high. In other word, the rating "9" is the boundary between soiling and non-soiling.

Absence of toner in an image area is rated on a scale of 1 to 10. The smaller the absence of toner in an image area is, the more serious the absence is. Thus, the smaller the absence is, the more serious the faintness of image is.

{Occurrence of Soiling}

The occurrence of soiling in a variety of external environmental conditions will be described.

Figure 4:
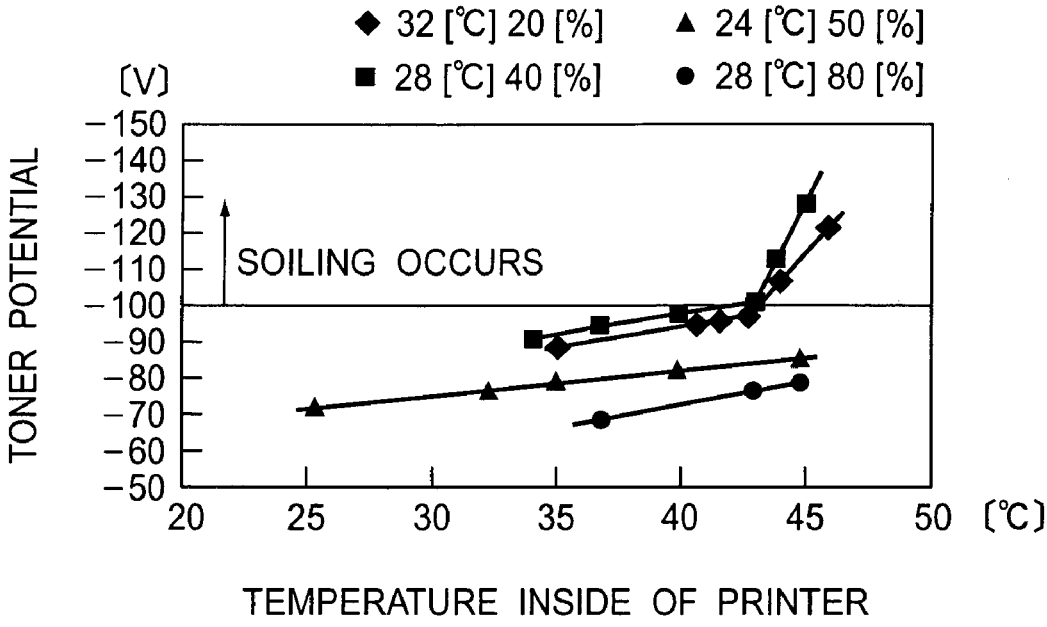
FIG. 4 is a first portion of illustration of occurrence of soiling.

FIG. 4 is a first portion of illustration of the occurrence of soiling. FIG. 4 plots temperature inside of the printer as the abscissa and toner potential as the ordinate.

Referring to FIG. 4, the toner potential generally increases with increasing temperature inside of the printer. The toner potential also varies in different ways depending on the temperature and humidity outside of the printer. When the printer operates in an environment of 24° C./50% RH (relative humidity) or 28° C./80% RH, the toner potential increases substantially linearly as the temperature inside of the printer rises but no soiling occurs.

When the printer operates in an environment of 32° C./20% RH or in an environment of 28° C./40% RH, if the temperature inside of the printer changes from low to high, the toner potential begins to increase sharply at 44° C., and soiling occurs at a temperature of 44° C. or higher.

Likewise, when the printer operates in environments of temperatures higher than 28° C. and humidities lower than 40% RH, if the temperature inside of the printer changes from low to high, the toner potential begins to sharply increase to exceed −100 V at a temperature inside of the printer of 44° C., so that soiling occurs at a temperature inside of the printer of 44° C.

{Occurrence of Soiling}

A description will be given of the occurrence of soiling when the temperature inside of the printer changes from low to high and from high to low.

Figure 5:
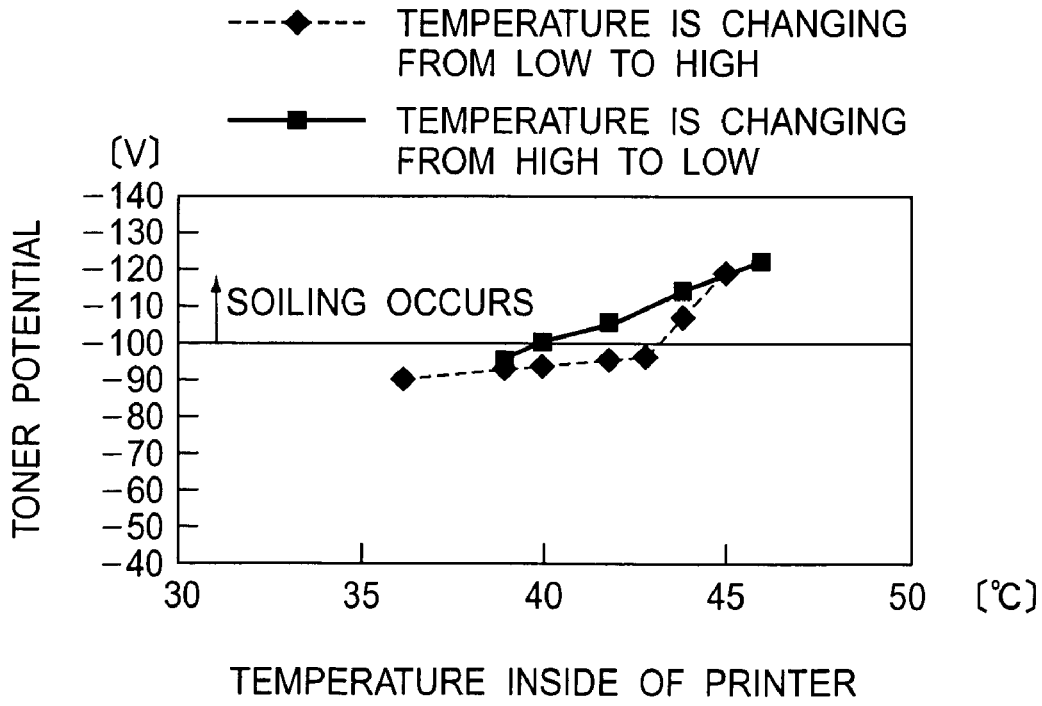
FIG. 5 is a second portion of illustration of the occurrence of soiling.

FIG. 5 is a second portion of illustration of the occurrence of soiling. FIG. 5 plots temperature inside of the printer as the abscissa and toner potential as the ordinate. The temperature outside of the printer is 32° C. and the humidity outside of the printer is 20%.

Referring to FIG. 5, when the temperature inside of the printer changes from low to high, soiling does not occur until the temperature exceeds 43° C. When the temperature inside of the printer changes from high to low, the toner potential decreases substantially linearly and soiling still occurs at a temperature lower than 44° C. and no soiling occurs once the temperature has decreased below 40° C. In other words, the relationship between the toner potential and the temperature inside of the printer exhibits a hysteresis loop characteristic.

One way of minimizing soiling is to decrease the voltage difference $V_{diff}$ ($=V_{SB}-V_{DB}$) between the developing voltage $V_{DB}$ and the toner supplying voltage $V_{SB}$. Usually, the toner supplying voltage $V_{SB}$ is higher than the developing voltage $V_{DB}$. The developing voltage $V_{DB}$ is set to, for example, −170 V and the toner supplying voltage $V_{SB}$ is set to, for example, −250 V. The voltage difference $V_{diff}$ is −250−(−170)=−80 V.

The changes in faintness level and soiling for various voltage differences $V_{diff}$ will be described.

Figure 6:
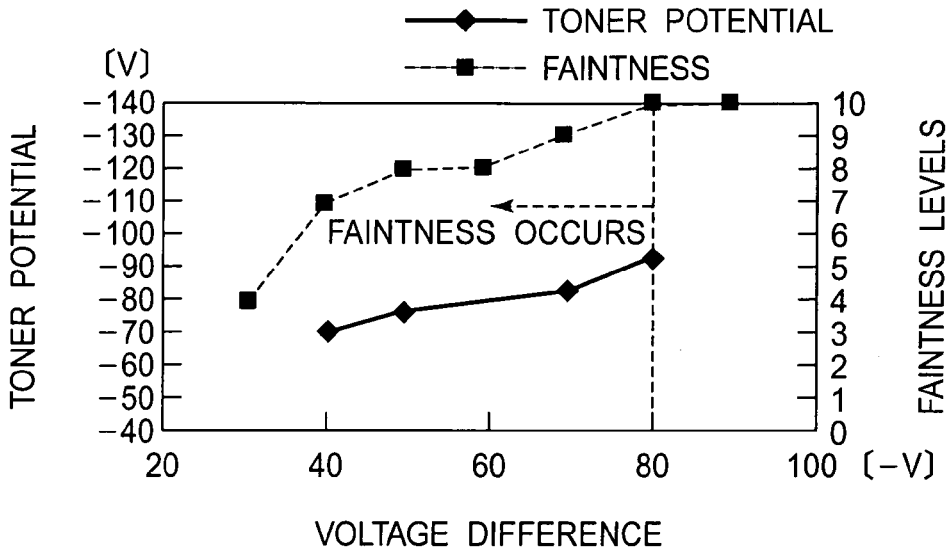
FIG. 6 illustrates occurrence of faintness.
Figure 7:
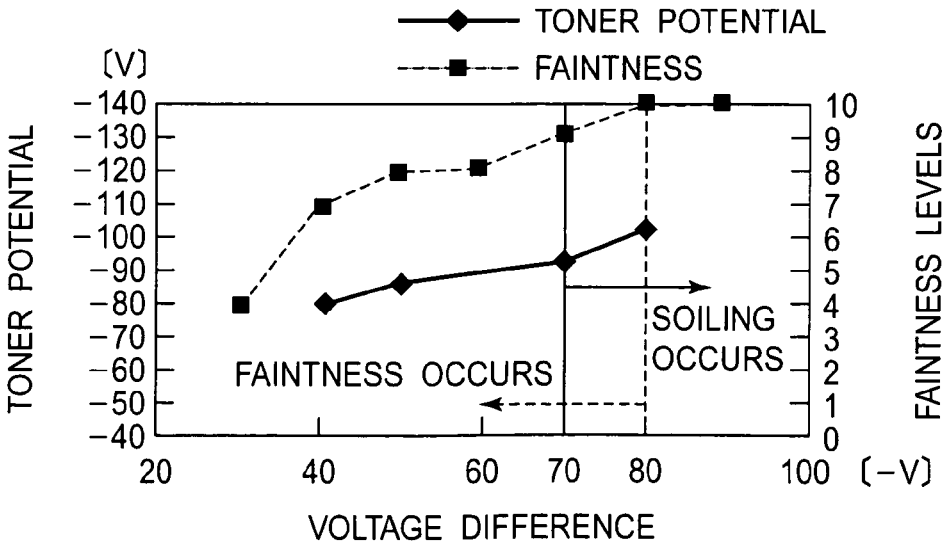
FIG. 7 illustrates the occurrence of faintness and soiling.

FIG. 6 illustrates the occurrence of faintness. FIG. 7 illustrates the occurrence of faintness and soiling. FIGS. 6 and 7 plot voltage difference $V_{diff}$ as the abscissa and toner potential and faintness as the ordinate. FIG. 6 assumes that the temperature and humidity outside of the printer are 32° C. and 20% RH, respectively, and the temperature inside of the printer is 35° C. FIG. 7 assumes that the temperature and humidity outside of the printer are 28° C. and 40% RH, respectively, and the temperature inside of the printer is 45° C.

Referring to FIGS. 6 and 7, no faintness occurs at temperatures of 35° C. (FIG. 6) and 45° C. (FIG. 7) inside of the printer if the voltage difference $V_{diff}$ is equal to or larger than −80 V.

Referring to FIG. 6, it is to be noted that the temperature inside of the printer is below 44° C., and therefore as is clear from FIG. 4, no soiling occurs for voltage difference equal to or larger than −80 V as long as the toner potential is lower than −100 V.

Referring to FIG. 7, it is to be noted that the temperature inside of the printer is above 44° C. Thus, when the temperature inside of the printer is 45° C., if the voltage difference $V_{diff}$ is equal to or larger than −80 V (as is clear from FIG. 4) and the toner potential is higher than −100 V, faintness does not occur. However, the toner potential exceeds −100 V at a voltage difference $V_{diff}$ equal to or larger than −74 V. FIG. 4 shows that a toner potential exceeding −100 V causes soiling. Thus, soiling occurs at the voltage difference $V_{diff}$ larger than −70 V. In other words, soiling may occur at the temperature inside of the printer of 35° C. even though the voltage difference $V_{diff}$ is within the same ranges as for the temperatures inside of the printer of 35° C.

If soiling occurs when the temperature inside of the printer is 45° C., soiling may be prevented by decreasing the voltage difference $V_{diff}$ less than −70 V so that the toner potential is lower, but faintness occurs for the voltage difference $V_{diff}$ is less than −80V.

If both soiling and the faintness occur in the first embodiment, priority should be given to minimizing soiling while allowing faintness to occur.

Assume that the printer operates in an environment of 28° C. or higher and 40% RH or lower. If soiling occurs at a temperature inside of the printer equal to or higher than a predetermined threshold of 40° C. when the temperature changes from high to low, then it is desirable that the voltage difference $V_{diff}$ is decreased by a predetermined value.

Figure 8:
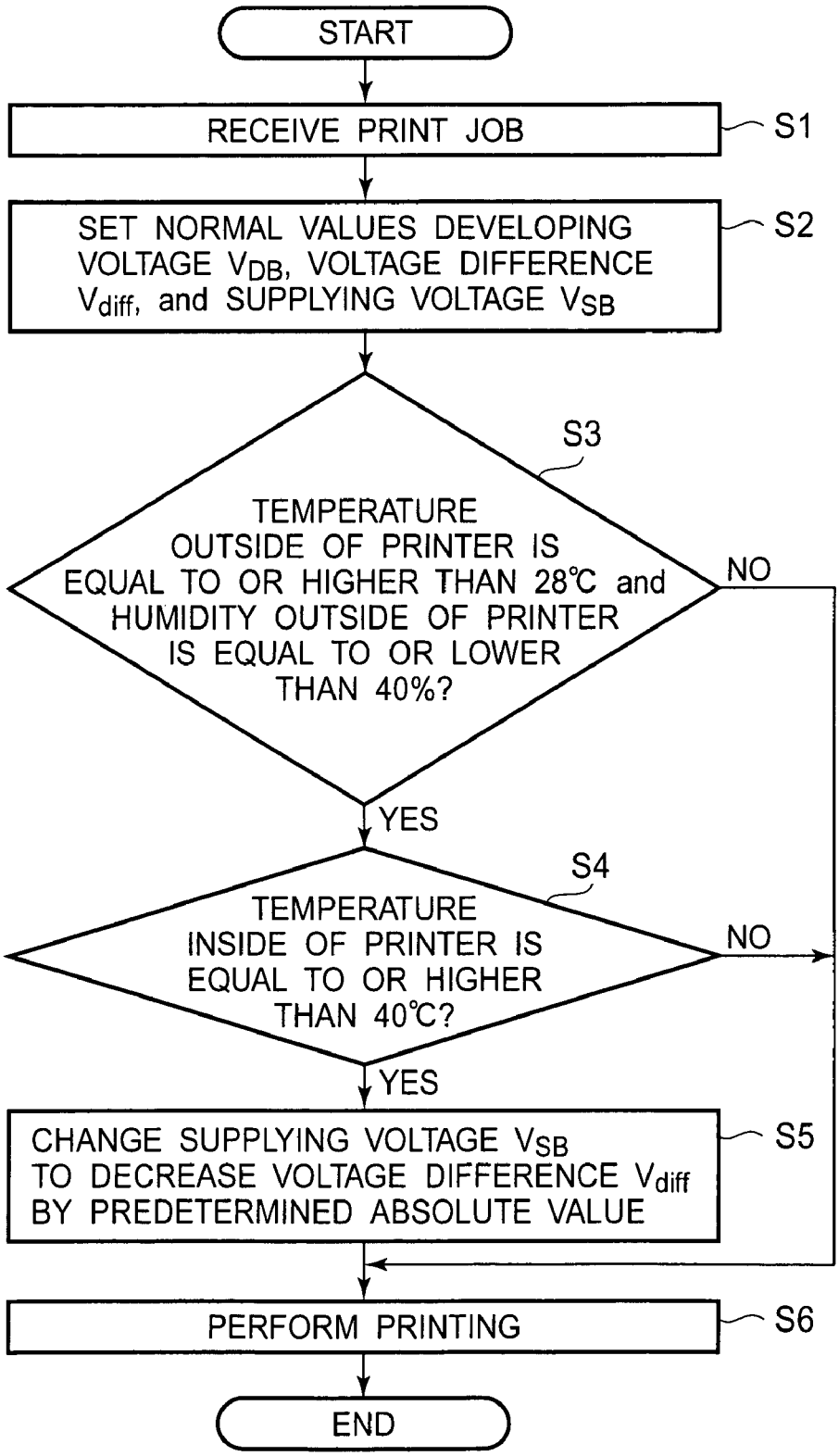
FIG. 8 is a flowchart illustrating the operation of the printer.

FIG. 8 is a flowchart illustrating the operation of the printer.

Upon receiving print data, a voltage setting section (not shown) of the voltage controller 40*a* (FIG. 2) performs a voltage setting process. Specifically, the developing voltage and the supplying voltage $V_{SB}$ are set. The supplying voltage $V_{SB}$ is subtracted from the developing voltage $V_{DB}$ to obtain the voltage difference $V_{diff}$. The voltage controller 40*a* determines the environmental conditions. Specifically, the voltage controller 40*a* makes a decision to determine whether the temperature outside of the printer detected by the external environment detector 41 is equal to or higher than 28° C. and the humidity outside of the printer detected by the external environment detector 41 is equal to or less than 40%. If the temperature outside of the printer detected by the external environment detector 41 is not equal to or higher than 28° C. and the humidity outside of the printer detected by the external environment detector 41 is not equal to or less than 40%, then the voltage setting section does not change the developing voltage $V_{DB}$ and supplying voltage $V_{SB}$ and the controller 40 performs printing with the previously set developing voltage $V_{DB}$ and supplying voltage $V_{SB}$.

If the temperature outside of the printer is equal to or higher than 28° C. and the humidity outside of the printer is equal to or lower than 40%, respectively, the voltage controller 40*a* makes a decision to determine whether the temperature inside of the printer detected by the internal temperature detector 42 is equal to or higher than 40° C. If the temperature inside of the printer is not equal to or higher than 40° C., the voltage setting section does not change the previously set developing voltage $V_{DB}$ and supplying voltage $V_{SB}$ and the controller 40 performs printing. If the temperature inside of the printer is equal to or higher than 40° C., the voltage setting section modifies the supplying voltage $V_{SB}$ with a correction value (e.g. 40 V) and sets a new supplying voltage $V_{SB}$. Then, the controller 40 performs printing.

The flowchart will be described.

Step S1: The print data is received.

Step S2: The normal values of the developing voltage $V_{DB}$ and supplying voltage $V_{SB}$ are set.

Step S3: A check is made to determine whether the temperature outside of the printer is equal to or higher than 28° C. and the humidity outside of the printer is equal to or lower than 40%. If YES, the program proceeds to step S4. If NO, the program jumps to step S6.

Step S4: A check is made to determine whether the temperature inside of the printer is equal to or higher than 40° C. If YES, the program proceeds to step S5. If NO, the program proceeds to step S6.

Step S5: The supplying voltage $V_{SB}$ is changed to decrease the voltage difference $V_{diff}$ by 40 V in absolute value.

Step S6: Printing is performed.

In the first embodiment, the developing voltage $V_{DB}$, supplying voltage $V_{SB}$, and voltage difference $V_{diff}$ are initially set to −170 V, −250 V, and −80 V, respectively. If the temperature inside of the printer is equal to or higher than 40° C., the voltage difference $V_{diff}$ is decreased by an absolute value of 40 V (i.e., $V_{diff}$=−40 V) to −40 V, and the developing voltage and the supplying voltage are set to −170 V and −210 V, respectively.

Figure 9:
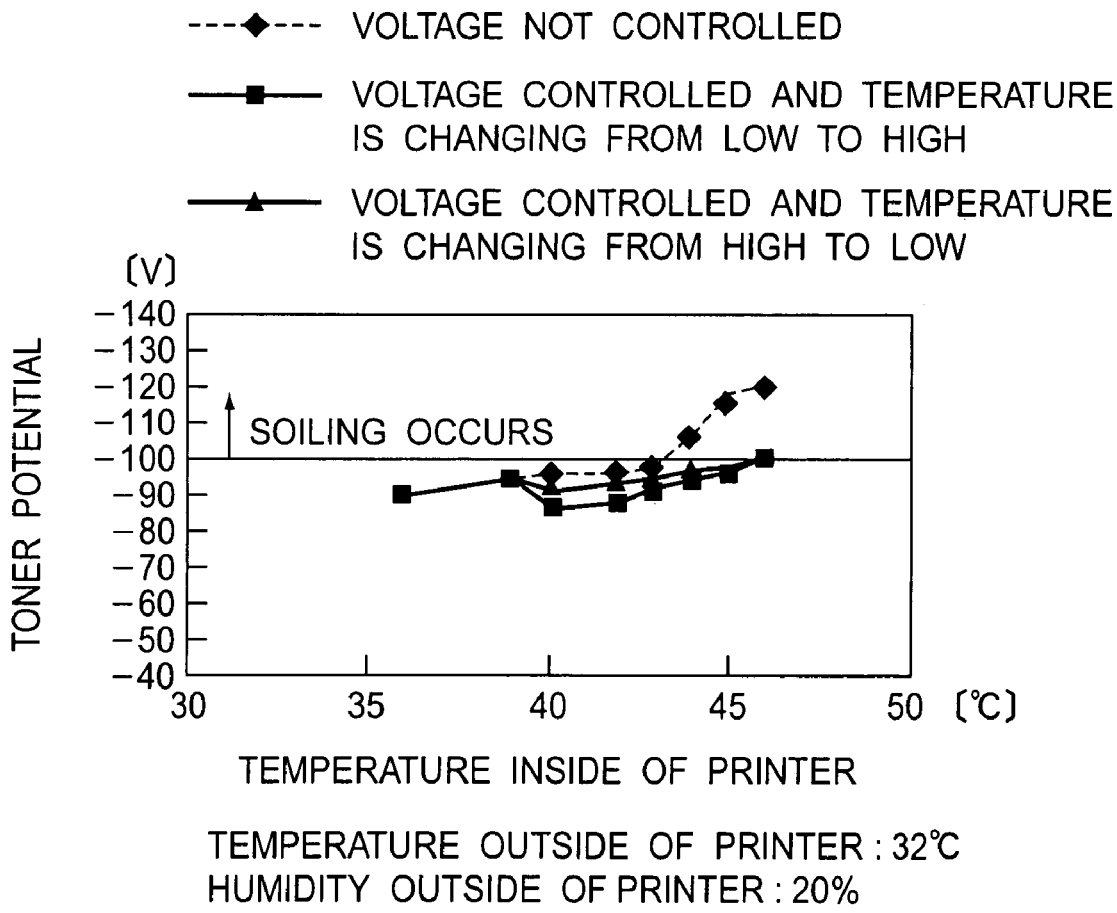
FIG. 9 is a third portion of illustration of the occurrence of soiling.

FIG. 9 is a third portion of illustration of the occurrence of soiling. FIG. 9 plots temperature inside of the printer as the abscissa and toner potential as the ordinate. The temperature and humidity outside of the printer are assumed to be 32° C. and 20%, respectively.

Referring to FIG. 9, without the voltage difference $V_{diff}$ controlled, soiling occurs if the temperature inside of the printer increases higher than 44° C. In contrast, with the voltage difference $V_{diff}$ controlled, soiling does not occur because the toner potential is low when the temperature inside of the printer is higher than 40° C. Soiling also does not occur when the temperature inside of the printer changes from high to low.

In the first embodiment, the voltage difference $V_{diff}$ is changed from the normal value to a smaller value than the initial value or the normal value only when the temperature and humidity outside of the printer are equal to or higher than 28° C. and equal to or lower than 40%, respectively, and the temperature inside of the printer is equal to or higher than 40° C. This retards occurrence of soiling. In environments of those other than the aforementioned conditions, the voltage difference $V_{diff}$ is maintained at the initial value or normal value in which no soiling occurs. Thus, soiling may be prevented so that the print quality is improved.

The first embodiment is configured such that every time the voltage controller 40*a* receives print data, the voltage difference $V_{diff}$ is corrected based on the outputs of the external environment detector 41 and internal temperature detector 42.

Second Embodiment

A second embodiment has the following features. A voltage difference $V_{diff}$ between a developing voltage $V_{DB}$ and a toner supplying voltage $V_{SB}$ is first corrected based on the outputs of an external environment detector 41 and an internal temperature detector 42. Thereafter, every time a print job is received from a host apparatus, the temperature inside of the printer is detected. The voltage difference $V_{diff}$ continues to be corrected until the temperature inside of the printer has decreased by a predetermined value from the value at which the voltage difference $V_{diff}$ begins to be corrected. Just as in the first embodiment, the relationship between the toner potential and the temperature inside of the printer exhibits a hysteresis loop characteristic similar to that shown in FIG. 5. Elements similar to those of the first embodiment have been given the same reference numerals, and their description is omitted.

Figure 10:
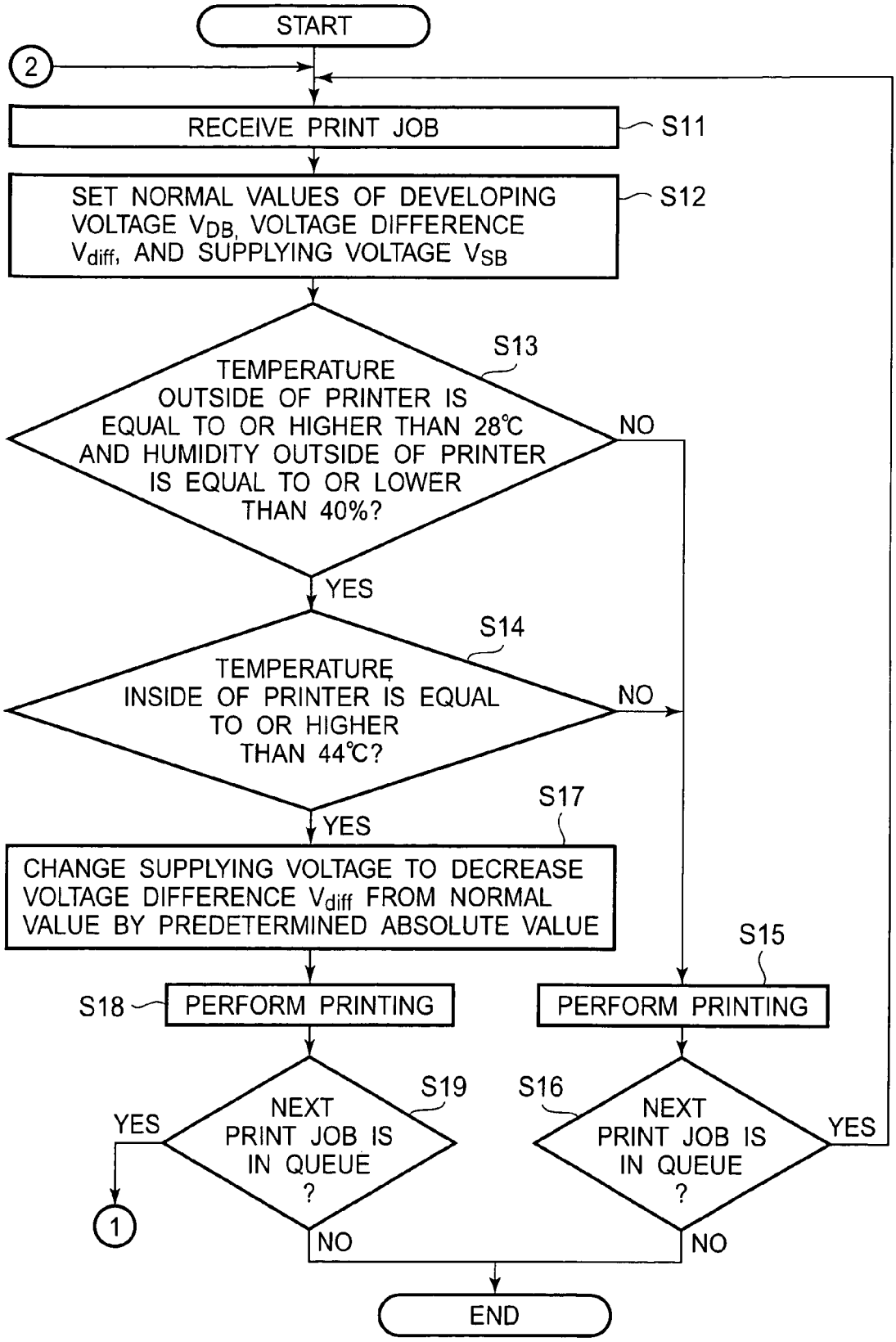
FIG. 10 is a first portion of a flowchart illustrating the operation of a printer of a second embodiment.
Figure 11:
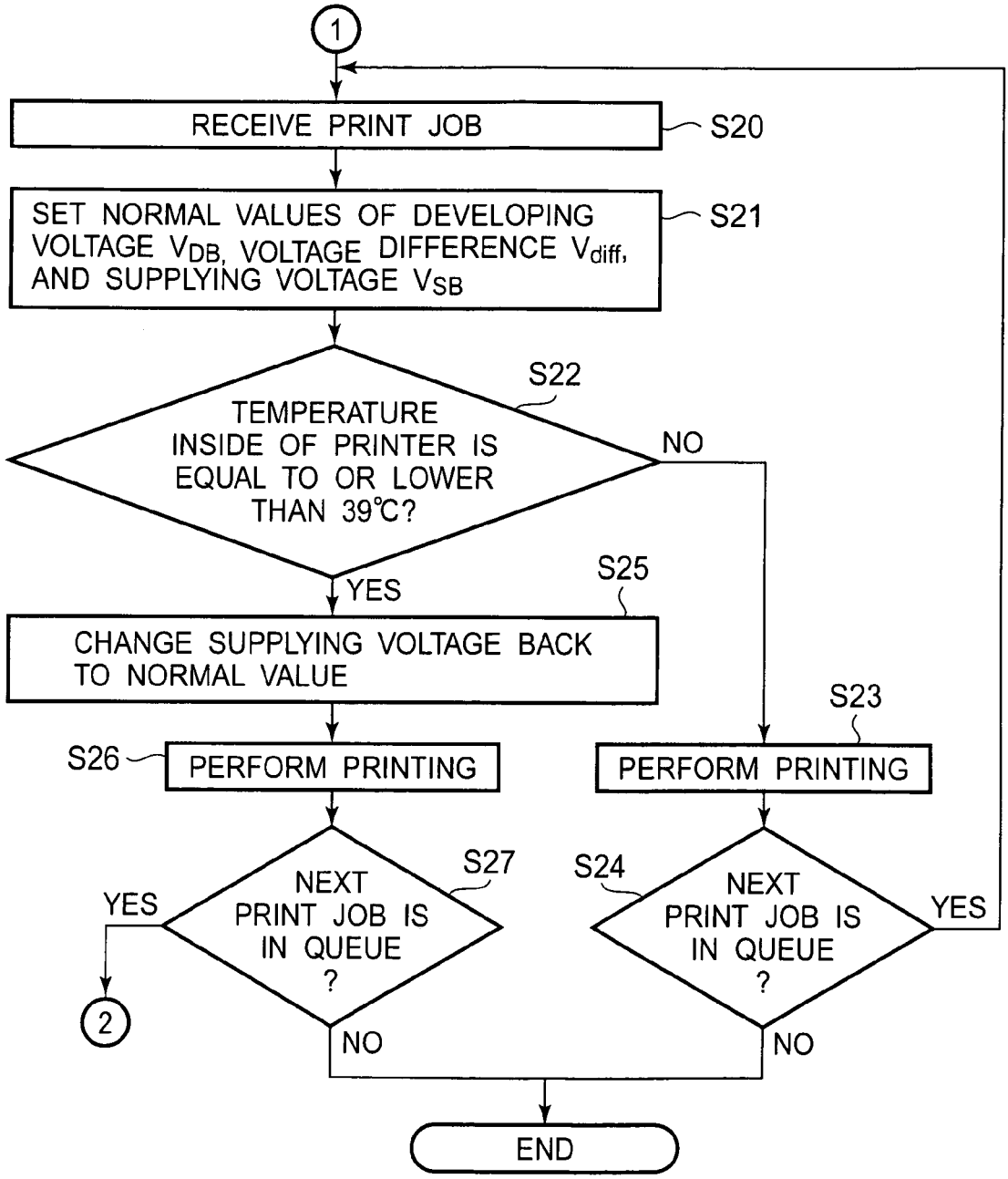
FIG. 11 is a second portion of the flowchart.

FIG. 10 is a first portion of a flowchart illustrating the operation of a printer of the second embodiment. FIG. 11 is a second portion of the flowchart.

Every time a print job is received, the correction of the voltage difference $V_{diff}$ is performed based on the results shown in FIG. 7 at temperatures inside of the printer of equal to or higher than 44° C., and is not performed at temperatures equal to or lower than 39° C.

Upon receiving a print job, the voltage setting section of the voltage controller 40*a* sets the normal values of the developing voltage $V_{DB}$ and the developing voltage $V_{DB}$ to determine the voltage difference $V_{diff}$. Then, the voltage controller 40*a* makes a decision to determine whether the temperature outside of the printer detected by the external environment detector 41 is equal to or higher than a threshold, i.e., 28° C. and the humidity outside of the printer is equal to or lower than a threshold, i.e., 40%. If the temperature is not equal to or higher than 28° C. and the humidity is not equal to or lower than 40%, the voltage setting section does not change the developing voltage $V_{DB}$ and supplying voltage $V_{SB}$, and the controller 40 performs printing at the previously set developing voltage $V_{DB}$ and the supplying voltage $V_{SB}$.

If the temperature is equal to or higher than 28° C. and the humidity is equal to or lower than 40%, then, the voltage controller 40*a* makes a decision to determine whether the temperature inside of the printer detected by the internal temperature detector 42 is equal to or higher than a threshold, i.e., 44° C. If the temperature inside of the printer is not equal to or higher than 44° C., the voltage setting section does not change the developing voltage $V_{DB}$ and supplying voltage $V_{SB}$, and the controller 40 performs printing at the previously set developing voltage $V_{DB}$ and the voltage difference $V_{diff}$. If the temperature inside of the printer is equal to or higher than 44° C., the voltage setting section changes the supplying voltage $V_{SB}$ to change the voltage difference $V_{diff}$ and then sets a new supplying voltage $V_{SB}$. Then the controller 40 performs printing at the newly set developing voltage $V_{DB}$ and supplying voltage $V_{SB}$.

After the voltage difference $V_{diff}$ has been corrected, upon receiving the next print job, the voltage setting section sets the developing voltage $V_{DB}$ and a new supply voltage $V_{SB}$. If the temperature inside of the printer is equal to or higher than 44° C., the voltage setting section changes the supplying voltage $V_{SB}$ to correct the voltage difference $V_{diff}$ with a predetermined correction value. Then, the controller 40 performs printing.

The voltage controller 40*a* makes a decision to determine whether the temperature inside of the printer detected by the internal temperature detector 42 is equal to or lower than a second threshold, i.e., 39° C. If the temperature is not equal to lower than 39° C., then the controller 40 performs printing with the developing voltage $V_{DB}$ and supplying voltage $V_{SB}$ after correction. If the temperature inside of the print is equal to or lower than 39° C., the voltage setting section sets the supplying voltage $V_{SB}$ back to the normal value to correct the voltage difference $V_{diff}$. Then, the controller 40 performs printing with the developing voltage $V_{DB}$ and supplying voltage $V_{SB}$.

The flowchart will be described with reference to FIGS. 10 and 11.

Step S11: A print job is received.

Step S12: The normal values of the developing voltage $V_{DB}$, voltage difference $V_{diff}$, and supplying voltage $V_{SB}$ are set.

Step S13: A decision is made to determine whether the temperature outside of the printer is equal to or higher than 28° C. and the humidity outside of the printer is equal to or lower than 40%. If YES, the program proceeds to step S14. If NO, the program proceeds to step S15.

Step S14: A decision is made to determine whether the temperature inside of the printer is equal to or higher than 44° C. If YES, then the program proceeds to step S17. If NO, the program proceeds to step S15.

Step S15: Printing is performed.

Step S16: A check is made to determine whether the next print job is in the queue. If the next print job is in the queue, then the program jumps back to step S11. If the next print job is not in the queue, the program ends.

Step S17: The supplying voltage $V_{SB}$ is changed to decrease the voltage difference $V_{diff}$ from the normal value by a predetermined value (e.g., 40 V).

Step S18: Printing is performed.

Step S19: A check is made to determine whether the next print job is in the queue. If YES, the program proceeds to step S20. If NO, the program ends.

Step S20: The next print job is received.

Step S21: The normal values of the developing voltage $V_{DB}$, voltage difference $V_{diff}$, and supplying voltage $V_{SB}$ are set.

Step S22: A check is made to determine whether the temperature inside of the printer is equal to or lower than 39° C. If YES, the program proceeds to step S25. If NO, the program proceeds to step S23.

Step S23: Printing is performed.

Step S24: A check is made to determine whether the next print job is in the queue. If YES, then the program loops back to step S20. If NO, the program ends.

Step S25: The supplying voltage $V_{SB}$ is changed to correct the voltage difference $V_{diff}$ back to the normal value.

Step S26: Printing is performed.

Step S27: A check is made to determine whether the next print job is in the queue. If YES, then the program jumps back to step S11. If NO, the programmed ends.

In the second embodiment, the developing voltage $V_{DB}$, supplying voltage $V_{SB}$, and voltage difference $V_{diff}$ are initially set to −170 V, −250 V, and −80 V, respectively. If the temperature inside of the printer is equal to or higher than 40° C., the supplying voltage is changed to correct the voltage difference $V_{diff}$ to a smaller value by 40 V (absolute value) to −40 V so that the developing voltage $V_{DB}$ is −170 V and the supplying voltage $V_{SB}$ is −210 V.

Figure 12:
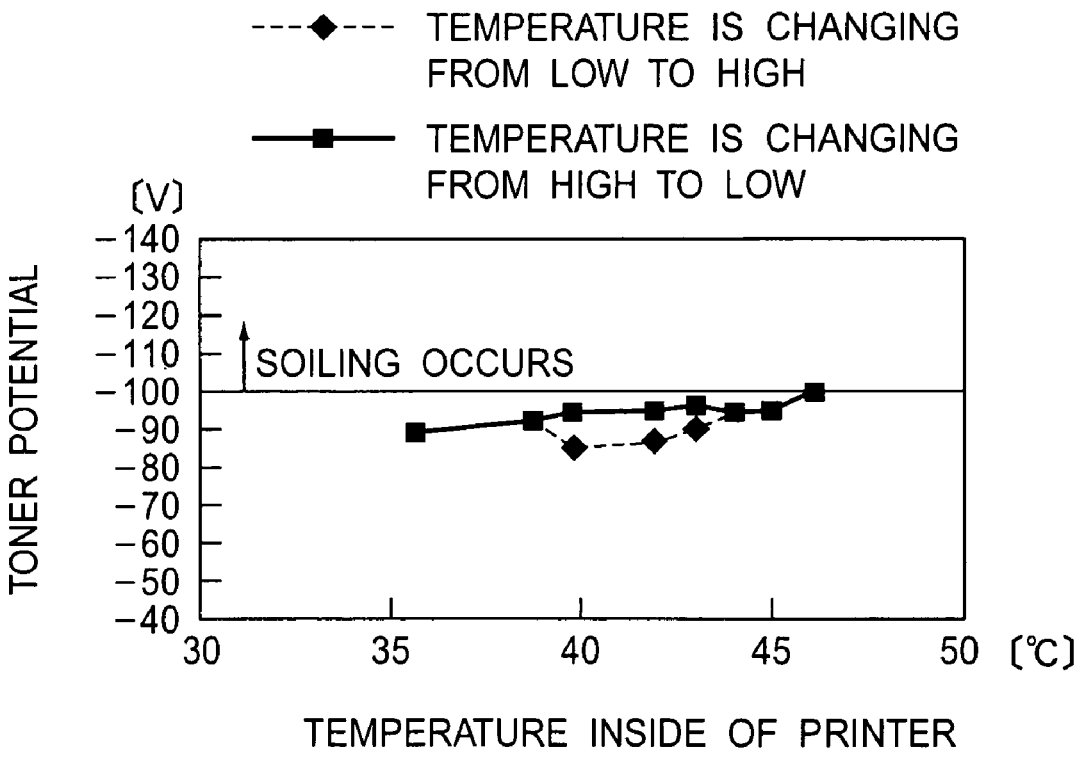
FIG. 12 illustrates soiling in the second embodiment.

FIG. 12 illustrates soiling in the second embodiment. FIG. 12 plots temperature inside of the printer as the abscissa and toner potential as the ordinate. It is assumed that the temperature and humidity outside of the printer are 32° C. and 20%, respectively.

Referring to FIG. 12, with the voltage difference $V_{diff}$ controlled, soiling does not occur because the toner potential is low when the temperature inside of the printer changes from low to high.

Figure 13:
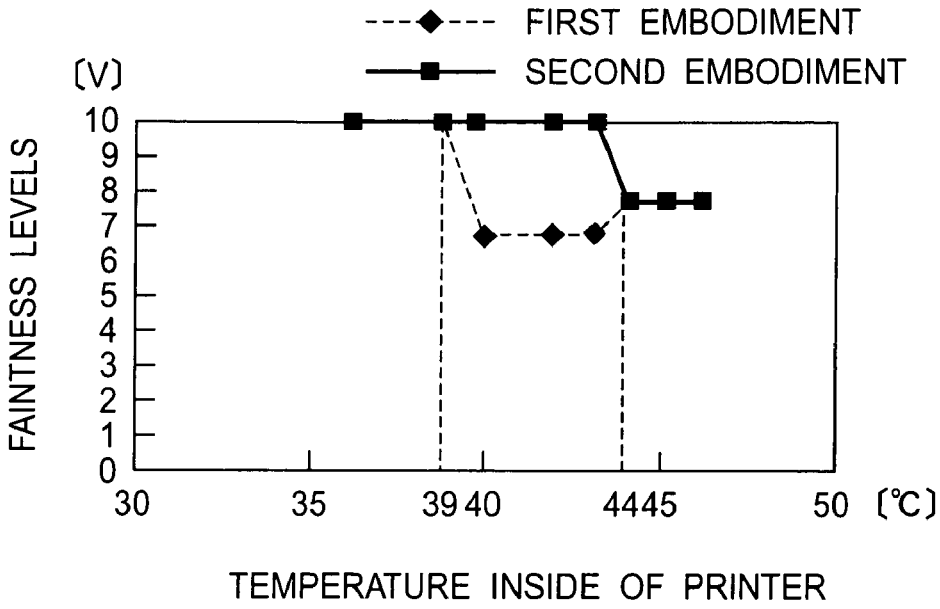
FIG. 13 illustrates occurrence of faintness in the first and second embodiments.

FIG. 13 illustrates the occurrence of faintness in the first and second embodiments. FIG. 13 plots temperature inside of the printer as the abscissa and level of faintness as the ordinate.

As is clear from FIG. 13, the normal value of voltage difference $V_{diff}$ provides a faintness level of "10" both in the first and second embodiments up to 39° C. when the temperature inside of the printer changes from low to high. In the first embodiment, when the temperature is equal to or higher than 40° C., the voltage difference $V_{diff}$ is made smaller, so that the faintness level becomes "7" at temperatures inside of the printer in the range of 40 to 44° C., and "8" at temperatures inside of the printer equal to or higher than 44° C.

In the second embodiment, the faintness is "10" when the temperature inside of the printer is less than 44° C., and is "8" when the temperature inside of the printer is equal to or higher than 44° C. Thus, the temperature at which faintness becomes poor is higher in the second embodiment than in the first embodiment.

When the temperature inside of the printer changes from high to low, the voltage difference $V_{diff}$ is set to the normal value at a temperature lower than 39° C. in the second embodiment, and at a temperature lower than 40° C. in the first embodiment. Thus, the faintness level may be substantially the same as that when the temperature inside of the printer changes from low to high.

As described above, when the temperature inside of the printer changes from high to low and from low to high, the voltage difference $V_{diff}$ is corrected at temperatures at which faintness may occur, so that correction may be made only in a narrow range of temperature. Thus, faintness is retarded to occur, so that faintness may be constrained to occur only at much higher temperatures.

Table 1 lists average print duties (the ratio of image area on the print paper to an entire printable area on the print paper) of one page of print paper and occurrence soiling in tabular form when the temperature changes from low to high. Table 1 reveals that faintness occurs if the average print duty is smaller than 5% and faintness does not occur if the average print duty is equal to or larger than 5%.

TABLE 1

| AVERAGE PRINT DUTY (%) | SOILING |
|---|---|
| 1.5 | POOR |
| 5 | GOOD |
| 15 | GOOD |
| 30 | GOOD |
| 50 | GOOD |
| 100 | GOOD |

Third Embodiment

A third embodiment is directed to the correction of a voltage difference $V_{diff}$ when an average print duty is smaller than 5%. Elements similar to those of the first and second embodiments have been given the same reference numerals and their description is omitted.

Figure 14:
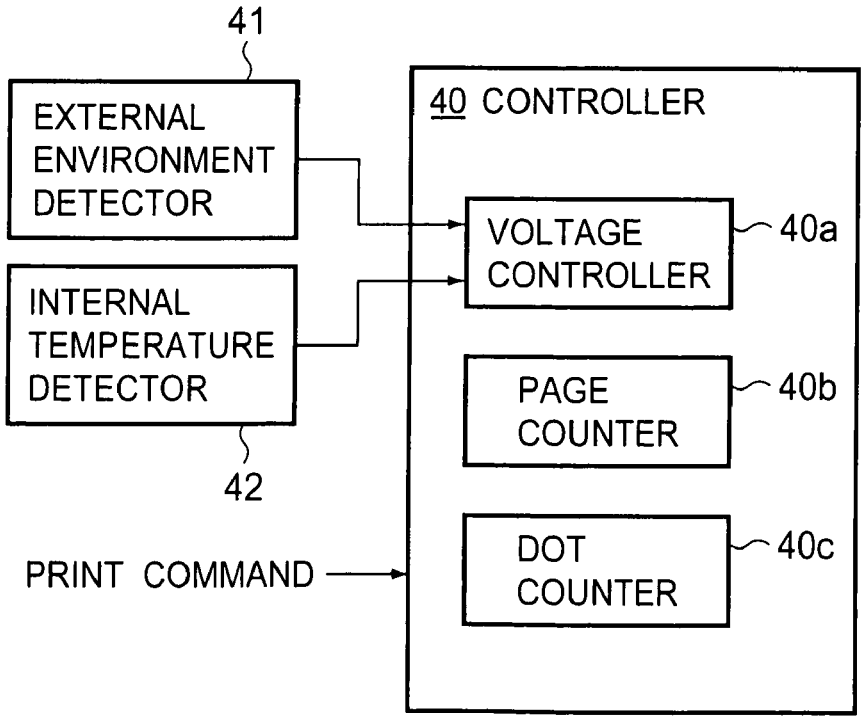
FIG. 14 is a block diagram illustrating a controller of a printer of the third embodiment.

FIG. 14 is a block diagram illustrating a controller 40 of a printer of the third embodiment.

Referring to FIG. 14, the controller 40 includes a voltage controller 40*a*, a page counter 40*b*, and a dot counter 40*c*. The voltage controller 40*a* controls voltages applied to a toner supplying roller 18 and a developing roller 16. The page counter 40*b* counts the number of pages to be printed. The dot counter 40*c* counts the number of dots to be formed by the LED heads 27BK, 27Y, 27M, and 27C (FIG. 2).

Average print duty is equivalent to average number of dots per page, which is a cumulative number of dots formed since the toner cartridge has been replaced by a new, unused toner cartridge, divided by a cumulative number of pages printed since the toner cartridge has been replaced by a new, unused toner cartridge. When printing is performed on A4 size paper with an average print duty of 5%, the number of dots is 792×8192. Thus, in the third embodiment, if an average print duty is less than a threshold of, for example, 792×8192, then the voltage difference $V_{diff}$ is corrected.

Figure 15:
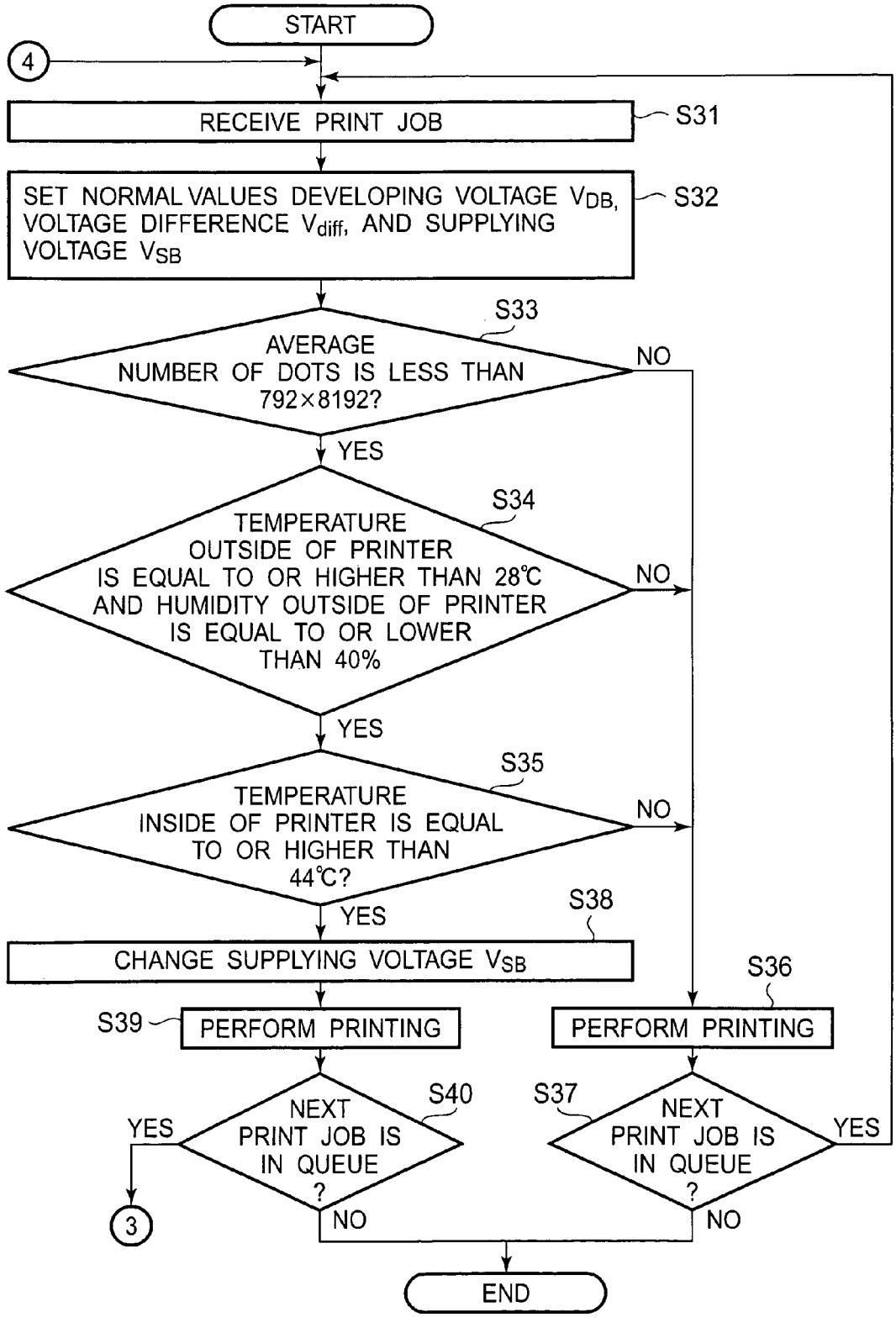
FIG. 15 is a first portion of a flowchart illustrating the operation of the printer of the third embodiment.
Figure 16:
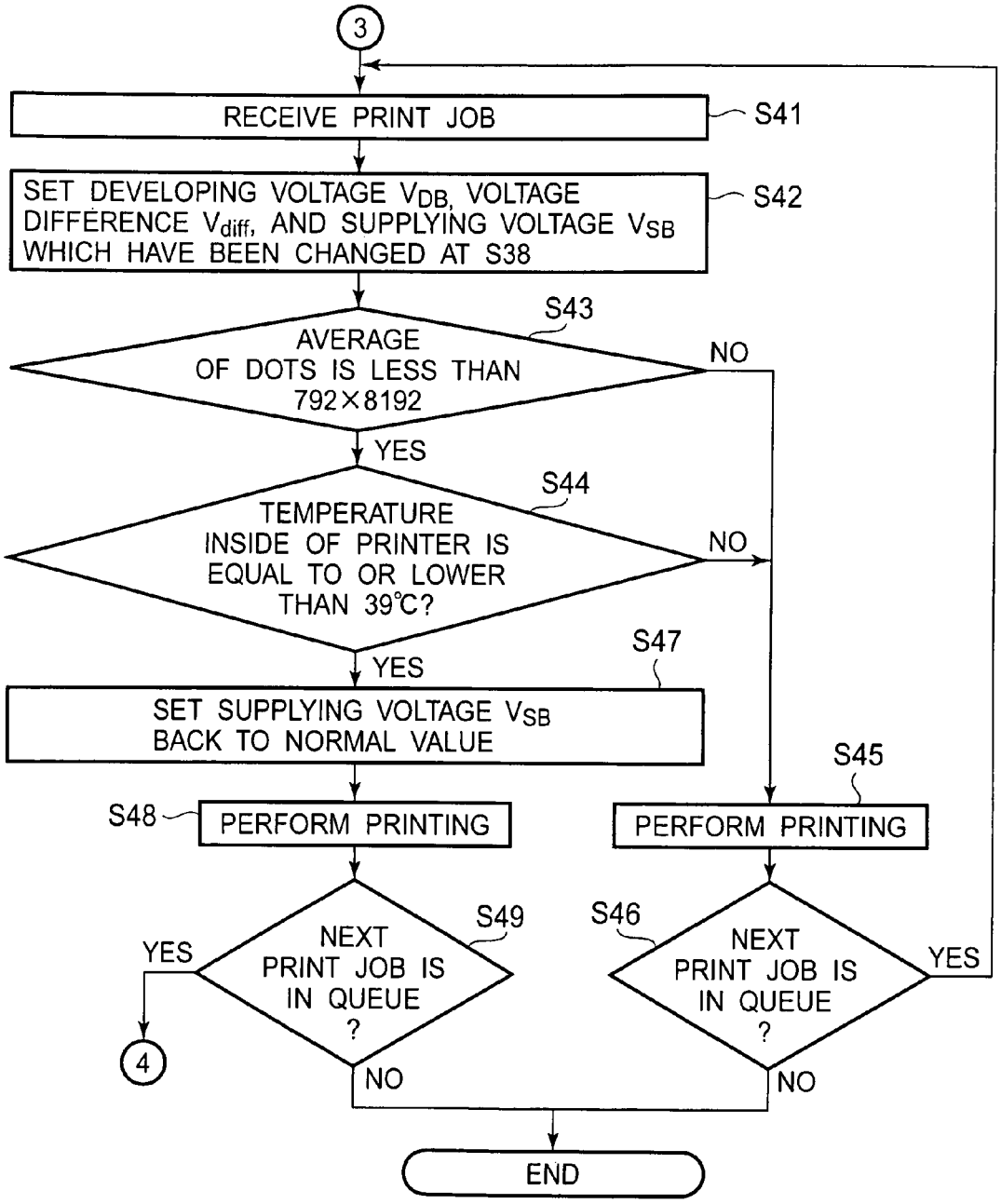
FIG. 16 is a second portion of the flowchart.

FIG. 15 is a first portion of a flowchart illustrating the operation of the printer. FIG. 16 is a second portion of the flowchart.

Upon receiving a print job, the voltage setting section of the voltage controller 40*a* (FIG. 14) sets the normal values of the developing voltage $V_{DB}$ and supplying voltage $V_{SB}$, thereby setting the voltage difference $V_{diff}$. Then, an average print duty calculating section of the voltage controller 40*a* reads the count of the dot counter 40*c* and the count of the page counter 40*b*, and then calculates an average number of dots based on the counts of the dot counter 40*c* and page counter 40*b*. The average print duty calculating section makes a decision to determine whether the average number of dots is less than 792×8192.

If the average number of dots is not less than 792×8192, then the voltage setting section does not change the previously set developing voltage $V_{DB}$ and supplying voltage $V_{SB}$, and thus the controller 40 of the controller 40 performs printing with the previously set developing voltage $V_{DB}$ and supplying voltage $V_{SB}$.

If the average number of dots is less than 792×8192, then the voltage controller 40*a* makes a decision to determine whether the temperature outside of the printer, detected by an environment detector 41, is equal to or higher than 28° C. and the humidity outside of the printer is not less than 40%. If the temperature outside of the printer is not equal to or higher than 28° C. and the humidity outside of the printer is not less than 40%, then the voltage setting section does not change the previously set developing voltage $V_{DB}$ and supplying voltage $V_{SB}$, and then the controller 40 performs printing with the previously set developing voltage $V_{DB}$ and supplying voltage $V_{SB}$.

If the temperature outside of the printer is equal to or higher than 28° C. and the humidity outside of the printer is equal to or lower than 40%, then the voltage controller 40*a* makes a decision to determine whether the temperature inside of the printer detected by the internal temperature detector 42 is equal to or higher than a first threshold, e.g., 44° C.

If the temperature inside of the printer is not equal to or higher than 44° C., the voltage setting section does not change the previously set developing voltage $V_{DB}$ and supplying voltage $V_{SB}$, and the controller 40 performs printing with the previously set developing voltage $V_{DB}$ and supplying voltage $V_{SB}$.

Conversely, if the temperature inside of the printer is equal to or higher than 44° C., then the voltage setting section changes the supplying voltage to correct the voltage difference $V_{diff}$ with a new value and then the controller 40 performs printing with the newly set developing voltage $V_{DB}$ and supplying voltage $V_{SB}$.

Upon receiving print job after correction of the voltage difference $V_{diff}$, the voltage setting section is ready to print with the developing voltage $V_{DB}$ and a new supplying voltage $V_{SB}$.

The average print duty calculating section reads the count of the dot counter 40*c* and the count of the page counter 40*b*, and then calculates the average number of dots per page. Then, the average print duty calculating section makes a decision to determine whether the average number of dots per page is less than 792×8192.

If the average number of dots is not less than 792×8192, the voltage setting section does not change the previously set developing voltage $V_{DB}$ and supplying voltage $V_{SB}$, and then the controller 40 performs printing with the previously set developing voltage $V_{DB}$ and supplying voltage $V_{SB}$.

If the average number of dots is less than 792×8192, then the voltage controller 40*a* makes a decision to determine whether the temperature inside of the printer detected by the internal temperature detector 42 is equal to or less than a second threshold, e.g., 39° C. If the temperature inside of the printer is higher than 39° C., the controller 40 performs printing with the newly set developing voltage $V_{DB}$ and supplying voltage $V_{SB}$. If the temperature inside of the printer is equal to or lower than 39° C., the controller 40 sets the supplying voltage $V_{SB}$ back to the normal value. Then, the controller 40 performs printing with the normal developing voltage $V_{DB}$ and newly supplying voltage $V_{SB}$.

The flowchart will be described.

Step S31: A print job is received.

Step S32: The normal values of the developing voltage $V_{DB}$, voltage difference $V_{diff}$, and supplying voltage $V_{SB}$ are set.

Step S33: A check is made to determine whether the average number of dots is less than 792×8192. If YES, the program proceeds to step S34. If NO, the program proceeds to step S36.

Step S34: A check is made to determine whether the temperature outside of the printer is equal to or higher than 28° C. and the humidity outside of the printer is equal to or lower than 40%. If YES, the program proceeds to step S35. If NO, then the program proceeds to step S36.

Step S35: A check is made to determine whether the temperature inside of the printer is equal to or higher than 44° C. If YES, the program proceeds to step S38. If NO, the program proceeds to step S36.

Step S36: Printing is performed.

Step S37: A check is made to determine whether a print job is in queue. If YES, the program jumps back to step S31. If NO, the program ends.

Step S38: The supplying voltage $V_{SB}$ is change to correct the voltage difference $V_{diff}$.

Step S39: Printing is performed.

Step S40: A check is made to determine whether a print job is in queue. If YES, the program proceeds to step S41. If NO, the program ends.

Step S41: Print data is received.

Step S42: The developing voltage $V_{DB}$ and supplying voltage $V_{SB}$ are set.

Step S43: A check is made to determine whether the average number of dots is less than 792×8192. If YES, the program proceeds to step S44. If NO, the program proceeds to step S45.

Step S44: A check is made to determine whether the temperature inside of the printer is equal to or lower than 39° C. If YES, the program proceeds to S47. If NO, the program proceeds to step S45.

Step S45: Printing is performed.

Step S46: A check is made to determine whether a print job is in queue. If YES, then the program jumps back to step S41. If NO, then the program ends.

Step S47: The supplying voltage $V_{SB}$ is changed back to the normal value.

Step S48: Printing is performed.

Step S49: A check is made to determine whether a print job is in queue. If YES, the program jumps back to step S31. If NO, the program ends.

As described above, the voltage difference $V_{diff}$ is selected such that no faintness occurs. If the average print duty is such that no soiling occurs, i.e., equal to or higher than 5%, the voltage difference $V_{diff}$ need not be corrected and therefore the control may be simplified.

The present invention has been described as being applied to a printer. The invention may also be applicable to copying machines, facsimile machines, and multi function printer (MFP).

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. An image forming apparatus, comprising:

an image bearing body on which an electrostatic latent image is formed;

a developer bearing member that supplies developer to the electrostatic latent image;

a developer supplying member that supplies the developer to said developer bearing member;

an environment detecting section that detects at least one of an environmental condition outside of the image forming apparatus and an environmental condition inside of the image forming apparatus; and a voltage controller that corrects a voltage difference between a first voltage applied to said developer bearing member and a second voltage applied to said developer supplying member, the voltage difference being corrected in accordance with the detected environmental condition;

wherein said environment detecting section includes:

an external environment detector that detects a temperature outside of the image forming apparatus and a humidity outside of the image forming apparatus; and an internal temperature detector that detects an internal temperature inside of the image forming apparatus;

wherein said voltage controller determines whether the following three conditions are satisfied:

Condition I: the temperature outside of the image forming apparatus is equal to or higher than a first reference, Condition II: the humidity outside of the image forming apparatus is equal to or lower than a second reference, and Condition III: the temperature inside of the image forming apparatus is equal to or higher than a third reference; and wherein if all of the conditions I, II, and III are satisfied, then said voltage controller decreases the voltage difference.

2. The image forming apparatus according to claim 1, further comprising:

an exposing section that illuminates a surface of said image bearing body to form the electrostatic latent image;

a dot counter that counts a number of dots that form the electrostatic latent image;

a page counter that counts a number of pages on which the electrostatic latent image is printed;

a print duty calculating section that calculates a ratio of the number of dots counted by said dot counter to the number of pages counted by said page counter; and a determining section that determines whether the ratio is less than a threshold value;

wherein if said determining section determines that the ratio is less than the threshold value, then said voltage controller corrects the voltage difference in accordance with a detection result of said environment detecting section.

3. The image forming apparatus according to claim 1, wherein said environment detecting section detects the temperature inside of the image forming apparatus and the temperature and the humidity outside of the image forming apparatus every time the image forming apparatus receives a print job that should be printed.

4. The image forming apparatus according to claim 1, wherein said voltage controller changes the second voltage so that the voltage difference changes.

* * * * *